US008034131B2

(12) United States Patent
Sutkowski et al.

(10) Patent No.: US 8,034,131 B2
(45) Date of Patent: Oct. 11, 2011

(54) METHOD OF INHIBITING DEPOSIT FORMATION IN A JET FUEL AT HIGH TEMPERATURES

(75) Inventors: Andrew C. Sutkowski, Bicester (GB); Roger W. Glyde, Bampton (GB)

(73) Assignee: Infineum International Limited, Oxfordshire (GB)

( * ) Notice: Subject to any disclaimer, the term of this patent is extended or adjusted under 35 U.S.C. 154(b) by 818 days.

(21) Appl. No.: 10/987,636

(22) Filed: Nov. 12, 2004

(65) Prior Publication Data

US 2005/0223629 A1 Oct. 13, 2005

(30) Foreign Application Priority Data

Nov. 13, 2003 (EP) ..... 03257180

(51) Int. Cl.
*C10L 1/196* (2006.01)

(52) U.S. Cl. ..... 44/391; 44/392; 44/393; 44/397; 44/398; 208/48 AA

(58) Field of Classification Search ..... 44/393, 44/391, 392; 208/48 AA
See application file for complete search history.

(56) References Cited

U.S. PATENT DOCUMENTS

| | | | | |
|---|---|---|---|---|
| 2,805,925 A | | 9/1957 | Biswell | 44/62 |
| 3,062,744 A | | 11/1962 | Thompson | 252/51.5 |
| 3,666,656 A | | 5/1972 | Stanley | 208/48 AA |
| 3,959,159 A | * | 5/1976 | Coleman | 508/467 |
| 4,882,034 A | * | 11/1989 | Tack et al. | 208/15 |
| 4,985,160 A | * | 1/1991 | Henry et al. | 508/470 |
| 5,194,068 A | * | 3/1993 | Mohr et al. | 44/391 |
| 5,476,521 A | * | 12/1995 | Gutierrez et al. | 44/348 |
| 5,906,970 A | * | 5/1999 | Tack | 508/470 |
| 6,391,071 B1 | * | 5/2002 | Krull et al. | 44/386 |
| 6,592,638 B2 | * | 7/2003 | Krull et al. | 44/383 |
| 6,610,110 B1 | * | 8/2003 | Manka | 44/331 |
| 7,326,262 B2 | * | 2/2008 | Eydoux et al. | 44/386 |

FOREIGN PATENT DOCUMENTS

| | | |
|---|---|---|
| GB | 0 802 588 A | 10/1958 |
| GB | 1 053 529 A | 1/1967 |

* cited by examiner

*Primary Examiner* — Ellen McAvoy

(57) ABSTRACT

A method of inhibiting deposit formation in a jet fuel at temperatures above 150° C., whilst not substantially adversely affecting the water separability of the jet fuel. The method includes the step of adding at least one copolymer, terpolymer or polymer of an ester of acrylic acid or methacrylic acid or a derivative thereof to the jet fuel; wherein the copolymer, terpolymer or polymer of an ester of acrylic acid or methacrylic acid or derivative thereof is copolymerized with a nitrogen-containing, amine-containing or amide-containing monomer; or the copolymer, terpolymer or polymer of an ester of acrylic acid or methacrylic acid or derivative thereof includes nitrogen-containing, amine-containing or amide-containing branches.

7 Claims, No Drawings

METHOD OF INHIBITING DEPOSIT FORMATION IN A JET FUEL AT HIGH TEMPERATURES

This invention relates to a method of inhibiting deposit formation in a jet fuel at high temperatures, such as, for example, temperatures above 150° C., whilst not substantially adversely affecting the water separability of the jet fuel.

In addition to fuelling aircraft, jet fuels are used in integrated aircraft thermal management systems to cool aircraft subsystems and engine lubricating oils. The jet fuel, for example, has to pass through heat exchangers that raise the temperature of the jet fuel to above 250° C. At these temperatures, thermal-oxidative degradation occurs leading to the formation of gums, lacquers and coke, which foul parts of the jet engine such as the burner nozzles, the afterburner spray assemblies, the manifolds, the thrust vectoring actuators, the fuel controls, the pumps, the valves, the filters and the heat exchangers. Engine smoke emissions and noise also increase as a result of the thermal-oxidative deposits.

Jet fuel is also exposed to low temperatures that cause water present in the jet fuel to freeze, which can cause plugging of filters and other small orifices, and occasionally engine flameout. Ground-based water-separators are therefore used to control the amount of water present in a jet fuel prior to fuelling an aircraft, and it is important that additives added to jet fuel do not block or disarm the filters in these separators.

WO 96/20990 discloses a method for cleaning and inhibiting the formation of fouling deposits on jet engine components. The method involves the addition of a derivative of (thio)phosphonic acid to the jet fuel. Unfortunately, the (thio) phosphonic acid disarms the filters in the ground-based water-separators. Therefore this additive must be added to the jet fuel at the skin of the aircraft, i.e. this additive must not be added to the jet fuel prior to fuelling the aircraft.

WO 99/25793 discloses the use of 'salixarenes' to prevent deposits in jet fuel at a temperature of 180° C. (see the examples).

U.S. Pat. No. 5,468,262 discloses the use of phenol-aldehyde-polyamine Mannich condensate with a succinic acid anhydride bearing a polyolefin to improve the thermal stability of jet fuel at 260° C.

U.S. Pat. No. 3,062,744 describes the use of a hydrochloric acid salt of a polymer formed from an amine-free monomer and a amine-containing monomer for reducing deposits in refinery heat exchangers. It is stated that polymer itself is not effective, only the HCl salt.

U.S. Pat. No. 2,805,925 relates to the stabilisation of petroleum based oils in storage. Polymers of amino-containing monomers with oleophilic monomers were found to be ineffective for demulsifying water-oil mixtures. Water separation was achieved by adding a further co-additive of a fatty acid amide.

GB 802,588 describes a fuel composition comprising a copolymer of a compound with at least one ethylenic linkage and at least one α-β-unsaturated monocarboxylic acid. The acid monomer may be derivatised with polar groups provided that at least 20% of the carboxyl groups remain unreacted.

In accordance with the present invention there is provided a method of inhibiting deposit formation in a jet fuel at temperatures above 150° C., preferably above 200° C., more preferably above 250° C., and even more preferably above 300° C., whilst not substantially adversely affecting the water separability of the jet fuel; the method including the step of adding at least one copolymer, terpolymer or polymer of an ester of acrylic acid or methacrylic acid or a derivative thereof to the jet fuel; wherein the copolymer, terpolymer or polymer of an ester of acrylic acid or methacrylic acid or derivative thereof is copolymerized with a nitrogen-containing, amine-containing or amide-containing monomer; or the copolymer, terpolymer or polymer of an ester of acrylic acid or methacrylic acid or derivative thereof includes nitrogen-containing, amine-containing or amide-containing branches.

The inventors have found that use of the polymers of the invention in jet fuel inhibits deposit formation at high temperatures such as, for example, 335° C. The inventors have also found that copolymers, terpolymers and polymers of acrylic acid or methacrylic acid or a derivative thereof do not block or disarm filters in ground-based water-separators. Therefore, polymers can be added to jet fuel before fuelling of an aircraft. Furthermore, any jet fuel removed from the aircraft can be returned to bulk storage without the additive having to be removed. A further advantage is that the polymers are free of sulphur and phosphorus. They are therefore more environmentally friendly than certain known additives that include sulphur and/or phosphorus.

As used in this specification, the term 'not substantially adversely affecting the water separability of the jet fuel' means that the treated jet fuel has a water separability rating which is not significantly different to the untreated fuel.

Water separability can be measured, for example by the Microseparometer (MSEP) test—ASTM D3984, which test is described herein in relation to the examples. Un-used, treated fuel can be returned to bulk storage without the need for the additive to be removed and the need for the additive to be combined with the fuel only on fuelling is obviated.

Preferably, the method also includes the step of adding at least one antioxidant to the jet fuel. The anti-oxidant is preferably an aminic or phenolic antioxidant. The anti-oxidant preferably includes both an aminic and a phenolic antioxidant.

Preferably, the method also includes the step of adding at least one dispersant to the jet fuel. The dispersant is preferably a succinimide or a derivative thereof.

In accordance with a further aspect of the present invention there is provided a method of improving the thermal-oxidative stability of a jet fuel at temperatures above 150° C., preferably above 200° C., more preferably above 250° C., and even more preferably above 300° C., whilst not substantially adversely affecting the water separability of the jet fuel; the method including the step of adding the copolymer, terpolymer or polymer of an ester of acrylic acid or methacrylic acid or derivative thereof as defined hereinabove to the jet fuel.

In accordance with a yet further aspect of the present invention there is provided a method of fuelling a jet aircraft, the method comprising the steps of, (a) retrieving a jet fuel composition from a storage facility;

(b) using ground-based water separation means to reduce the amount of water in the jet fuel composition to an acceptable level; and, (c) supplying the jet fuel composition to the aircraft;

wherein the jet fuel composition comprises a jet fuel to which has been added at least one copolymer, terpolymer or polymer of an ester of acrylic acid or methacrylic acid or a derivative thereof; and wherein the copolymer, terpolymer or polymer of an ester of acrylic acid or methacrylic acid or derivative thereof is copolymerized with a nitrogen-containing, amine-containing or amide-containing monomer; or the copolymer, terpolymer or polymer of an ester of acrylic acid or methacrylic acid or derivative thereof includes nitrogen-containing, amine-containing or amide-containing branches For civilian aircraft use, jet fuel may transferred from remote storage facilities through pipelines or be stored in on-site tanks. For non-civilian use, jet fuel is usually stored in on-site tanks and often for a considerable amount of time. In all of these types of storage facility, there is the opportunity for the fuel to become contaminated with water, especially as storage tanks and such-like are commonly underground.

The problems associated with water ingress into jet fuels have been discussed hereinabove, and thus the use of ground-based water separation means is commonplace. Suitable types of water separation means will be known to those skilled in the art, for example, coalescers.

Jet fuels are designated by such terms as JP-4, JP-5, JP-7, JP-8, Jet A and Jet A-1. JP-4 and JP-5 are fuels defined by U.S. military specification MIL-T-5624-N and JP-8 and JP-8+1 00 fuels are defined by U.S. Military Specification MIL-T83133-D. Jet A, Jet A-1 and Jet B are defined by ASTM specification D1655.

Copolymer, Terpolymer or Polymer of an Ester of Acrylic Acid or Methacrylic Acid or a Derivative Thereof The copolymers, terpolymers and polymers of an ester of acrylic acid or methacrylic acid or a derivative thereof may be branched or linear. Suitable are those polymers of ethylenically unsaturated monomers such as methacrylic or acrylic acid esters of alcohols having about 1 to 40 carbon atoms, such as methylacrylate, ethylacrylate, n-propylacrylate, lauryl acrylate, stearyl acrylate, methylmethacrylate, ethylmethacrylate, n-propylmethacrylate, lauryl methacrylate, stearyl methacrylate, isodecylmethacrylate, 2-ethylhexylmethacrylate and the like. These copolymers, terpolymers and polymers may have number average molecular weights (Mn) of 1,000 to 10,000,000 and preferably the molecular weight range is from about 5,000 to 1,000,000, most preferably 5,000 to 100,000. A mixture of copolymers, terpolymers and polymers of esters of acrylic acid or methacrylic acid may also be used.

In an embodiment, the copolymer, terpolymer or polymer of an ester of acrylic acid or methacrylic acid or derivative thereof does not include methyl acrylate or ethyl acrylate monomers.

The acrylate or methacrylate monomer or derivative thereof is copolymerized with a nitrogen-containing, amine-containing or amide-containing monomer, or the acrylate or methacrylate main chain polymer is provided so as to contain sites suitable for grafting, and then nitrogen-containing, amine-containing or amide-containing branches, either monomers or macromonomers, are grafted onto the main chain. Transesterification reactions or amidation reactions may also be employed to produce the same products. Preferably, the copolymer, terpolymer or polymer will contain 0.01 to 5 wt. % nitrogen, more preferably 0.02 to 1 wt. % nitrogen, even more preferably 0.04 to 0.15 wt. % nitrogen.

Examples of amine-containing monomers include: the basic amino substituted olefins such as p-(2-diethylaminoethyl) styrene; basic nitrogen-containing heterocycles having a polymerizable ethylenically unsaturated substituent, such as the vinyl pyridines or the vinyl pyrrolidones; esters of amino alcohols with unsaturated carboxylic acids such as dimethylaminoethyl methacrylate, diethylaminoethyl methacrylate, tertiary butylaminoethyl methacrylate or dimethylaminopropyl methacrylate; amides of diamines with unsaturated carboxylic acids, such as dimethylaminopropyl methacrylamide; amides of polyamines with unsaturated carboxylic acids, examples of such polyamines being ethylene diamine (EDA), diethylene triamine (DETA), triethylene tetramine (TETA), tetraethylene pentamine (TEPA), pentaethylene hexamine (PEHA), and higher polyamines, PAM (N=7,8) and Heavy Polyamine (N>8); morpholine derivatives of unsaturated carboxylic acids, such as N-(aminopropyl)morpholine derivatives; and polymerizable unsaturated basic amines such as allyl amine.

Particularly preferred is a copolymer of a methacrylate ester of a $C_8$-$C_{14}$ alcohol with a methacrylate ester of an N,N-dialkylaminoalkyl alcohol, such as N,N dimethyl-2-aminoethanol.

The copolymer, terpolymer or polymer of acrylic acid or methacrylic acid or derivative thereof is preferably used in amounts ranging from 5-1,000, preferably 5-400 ppm, more preferably about 10-160 ppm (by weight).

Antioxidant

The method may also include the addition of at least one antioxidant to the jet fuel. The antioxidant may be phenolic, aminic or sulphur-containing. The antioxidant preferably includes a mixture of a phenolic and an aminic antioxidant.

The antioxidant may be added to the jet fuel in an amount ranging from about 0.5 to 200 ppm, preferably 1 to 100 ppm, more preferably about 5 to 60 ppm, and most preferably 10 to 50 ppm by weight.

Preferred phenolic antioxidants are hindered phenolics which contain a sterically hindered hydroxyl group, and include those derivatives of dihydroxy aryl compounds in which the hydroxyl groups are in the o- or p-position to each other. Typical phenolic antioxidants include the hindered phenols substituted with alkyl groups of a total of 6 or more carbon atoms and the alkylene coupled derivatives of these hindered phenols. Examples of phenolic materials of this type are 2,6-di-t-butyl-4-methyl phenol (BHT, butylated hydroxy toluene); 2-t-butyl-4-heptyl phenol; 2-t-butyl-4-octyl phenol; 2-t-butyl-4-nonyl phenol; 2-t-butyl-4-dodecyl phenol; 2,6-di-t -butyl-4-heptyl phenol; 2,6-di-t-butyl-4-dodecyl phenol; 2-methyl-6-di-t-butyl-4-heptyl phenol; and 2-methyl-6-di-t-butyl-4-dodecyl phenol. Examples of ortho coupled phenols include 2,2'-bis(6-t-butyl-4-heptyl phenol); 2,2'-bis(6-t-butyl-4-octyl phenol); and 2,2'-bis(6-t-butyl-4-dodecyl phenol). Sulfur containing phenols can also be used. The sulfur can be present as either aromatic or aliphatic sulfur within the phenolic antioxidant molecule. BHT is especially preferred, as are 2,6- and 2,4-di-t-butylphenol and 2,4,5- and 2,4,6-triisopropylphenol, especially for use in jet fuels.

Suitable aromatic aminic antioxidants include aromatic triazoles, phenothiazines, diphenylamines, alkyl diphenylamines containing 1 or 2 alkyl substituents each having up to about 16 carbon atoms, phenyl-α-naphthylamies, phenyl-β-naphthylamines, alkyl- or aralkyl-substituted phenyl-α-naphthylamines containing 1 or 2 alkyl or aralkyl groups each having up to about 16 carbon atoms, alkyl- or aralkyl-substituted phenyl-β-naphthylamines containing 1 or 2 alkyl or aralkyl groups each having up to about 16 carbon atoms, and similar compounds.

A preferred type of aminic antioxidant is an alkylated diphenylamine of the general formula

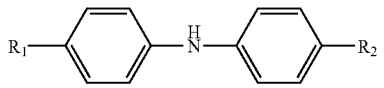

wherein $R_1$ is an alky group, preferably a branched alkyl group, having 8 to 12 carbon atoms, more preferably 8 or 9 carbon atoms, and $R_2$ is a hydrogen atom or an alkyl group, preferably a branched alkyl group, having 8 to 12 carbon atoms, preferably 8 or 9 carbon atoms. Most preferably, $R_1$ and $R_2$ are the same. One such preferred compound is available commercially as Naugalube 438L, which is believed to be predominantly a 4,4'-dinonyidiphenylamine (i.e. a bis(4-nonylphenyl)amine) wherein the nonyl groups are branched. Another preferred commercially available compound is Irganox L-57, which is believed to be an alkylated diphenyl amine containing both butyl and iso-octyl groups.

The antioxidant may also be at least one sulfur-containing antioxidant selected from the following:

(i) thiuram disulfides of the formula $(R^1R^2NCS)S_2(SNCR^3R^4)$ wherein each of $R^1$, $R^2$, $R^3$ and $R^4$ are the same or different and are substituted or unsubstituted alkyl, alkenyl, cycloalkyl or aryl of 1-200 carbon atoms, the substituent being N, S or O, and $R^1R^2$ or $R^3R^4$ together may optionally be cycloalkyl;

(ii) dithiocarbamates of the formula $R^5(R^6)NC(:S)—X—(S:)CN(R^7)R^8$ wherein each of $R^5$, $R^6$, $R^7$ and $R^8$ are the same or different and are substituted or unsubstituted alkyl, alkenyl, cycloalkyl or aryl of 1-200 carbon atoms, the substituent being N, S or O, and $R^5R^6$ or $R^7R^8$ together may optionally be cycloalkyl, and where X may be S, $S_2$, or $—S(CH_2)_nS—$ wherein n is 1-10; and (iii) thioureas or substituted thioureas of the formula $R^9NHC(:S)—N(R^{10})R^{11}$ wherein each of $R^9$, $R^{10}$ and $R^{11}$ are the same or different and are hydrogen, substituted or unsubstituted alkyl, alkenyl, cycloalkyl or aryl of 1-200 carbon atoms, the substituent being N, S or O, and $R^{10}R^{11}$ together may optionally be cycloalkyl.

Suitable thiuram disulfide antioxidants are represented by the formula $(R^1R^2NCS)S_2(SCNR^3R^4)$ where each of $R^1$, $R^2$, $R^3$ and $R^4$ may be the same or different and may be an alkyl, cycloalkyl or alkenyl of about 1 to 200 carbon atoms also containing N, S or O heteroatoms or an aryl or alkyl aryl of about 1 to 200 carbon atoms which may optionally contain N, S or O heteroatoms. Taken together $R^1R^2$ or $R^3R^4$ may be cycloalkyl. Preferably R is an alkyl group of 1 to 20 carbon atoms, such as a coco alkyl group, that is, an alkyl group comprising a mixture of alkyls having 10 to 14 carbon atoms. Examples of other suitable thiuram disulfides are tetramethylthiuram disulfide, tetraethylthiuram disulfide and dipentamethylenethiuram disulfide.

While the thiuram disulfides are the preferred sulfur-containing antioxidants, dithiocarbamates and thioureas may also be used. Suitable dithiocarbamates are those of the formula $R^5(R^6)NC(:S)—X—(S:)CN(R^7)R^8$ where each of $R^5$, $R^6$, $R^7$ and $R^8$ may be the same or different and may be substituted or unsubstituted alkyl, alkenyl, cycloalkyl or aryl of 1-200 carbon atoms, the substituent being N, S or O and $R^5R^5$ or $R^7R^8$ together may be cycloalkyl and where X may be S, $S_2$, or $—S(CH_2)_nS—$ wherein n is 1-10, such as methylene bis(dibutyldithiocarbamate), bis(dimethylthiocarbamoyl) monosulfide and bis(dibutylthiocarbamoyl)disulfide. In general the thioureas may be represented by the formula $R^9NHC(:S)—N(R^{10})R^{11}$ where each of $R^9$, $R^{10}$ and $R^{11}$ may be the same or different and may be hydrogen, substituted or unsubstituted alkyl, alkenyl, cycloalkyl or aryl of 1-200 carbon atoms, the substituent being N, S or O and $R^{10}R^{11}$ together may be cycloalkyl. Suitable thiourea antioxidants include thiourea, $(NH_2)_2CS$ and substituted derivatives thereof such as N-phenyl-N'-(p-hydroxylphenyl) thiourea and N-phenyl-N'-(p -dimethylaminophenyl)thiourea. The preparation of these thioureas is more fully described in U.S. Pat. No. 2,683,081.

Dispersant

The method of the present invention preferably includes the step of adding at least one dispersant to the jet fuel.

A noteworthy class of dispersants are "ashless", meaning a non-metallic organic material that forms substantially no ash on combustion, in contrast to metal-containing, hence ash-forming, materials. Ashless dispersants comprise a long chain hydrocarbon with a polar head, the polarity being derived from inclusion of, e.g. an 0, P or N atom. The hydrocarbon is an oleophilic group that confers oil-solubility, having for example 40 to 500 carbon atoms. Thus, ashless dispersants may comprise an oil-soluble polymeric hydrocarbon backbone having functional groups that are capable of associating with particles to be dispersed.

Examples of ashless dispersants are succinimides, e.g. polyisobutene succinic anhydride and polyamine condensation products that may be borated or unborated.

The dispersant is preferably a succinimide or derivative thereof.

If present, the dispersant is preferably added to the jet fuel in an amount from 10 to 100 ppm, preferably 10 to 50 ppm.

Additional Components

Additional components may also be added to the jet fuel. The additional components include a metal deactivator, a lubricity additive such as fatty acid, a dimer of fatty acids, an ester of fatty acids or a dimer of fatty acids, a corrosion inhibitor, an anti-icing additive such as ethylene glycol monomethyl ether or diethylene glycol monomethyl ether, a biocide, an anti-rust agent, an anti-foam agent, a demulsifier, a detergent, a cetane improver, a stabiliser, a static dissipater additive and the like, and mixtures thereof.

The metal deactivator may be added in an amount ranging from about 0.1-50 ppm of a metal deactivator, preferably 1-10 ppm by weight. Examples of suitable metal deactivators are:

(a) Benzotriazoles and derivatives thereof, for example, 4- or 5-alkylbenzotriazoles (e.g. tolutriazole) and derivatives thereof; 4,5,6,7-tetrahydrobenzotriazole and 5,5'-methylenebisbenzotriazole; Mannich bases of benzotriazole or tolutriazole, e.g. 1-[bis(2-ethylhexyl)aminomethyl]tolutriazole and 1-[bis(2-ethylhexyl)amino-methyl]benzotriazole; and alloxyalkyl1 benzotdazoles such as 1-(nonyloxymethyl)-benzotriazole, 1-(1-butoxyethyl) benzotriazole and 1-(1-cyclohexyloxybutyl)-tolutriazole;

(b) 1,2,4-Triazoles and derivatives thereof, for example, 3-alkyl(or aryl)-1,2,4-triazoles, and Mannich bases of 1,2,4-triazoles, such as 1-[bis(2-ethylhexyl)aminomethyl-1,2,4-triazole; alkoxyalkyl-1,2,4-triazoles such as 1-(1-butoxytheyl)-1,2,4-trizole; and acylated 3-amino-1,2,4-triazoles;

(c) Imidazole derivatives, for example 4,4'-methylenebis(2-undecyl-5-methylimidazole) and bis[(N-methyl)imidazol-2-yl]carbinol octyl ether;

(d) Sulfur-containing heterocyclic compounds, for example 2-mercaptobenzothiazole, 2,5-dimercapto-1,3,4-thiadiazole and derivatives thereof; and 3,5-bis[di(2-ethyl-hexyl) aminomethyl]-1,3,4-thiadiazolin-2-one;

and (e) Amino compounds and imino compounds, such as N,N'-disalicylidene propylene diamine, which is preferred, salicylaminoguanadine and salts thereof.

The invention will now be described, by way of example only, with reference to the following examples:

EXAMPLES

Copolymers, terpolymers and polymers of esters of acrylic acid or methacrylic acid and derivatives thereof were prepared using the following method:

The (meth)acrylate monomers and solvent were added to a suitably sized 3-neck round bottom flask equipped with a magnetic stirrer, condenser, nitrogen over-pressure and subaseal. The mixture was stirred and sparged with nitrogen for 30 minutes using a long nitrogen fed syringe needle inserted through the suba-seal. The reaction mixture was warmed to the reaction temperature of 80° C. and the free-radical initiator was added, via a syringe, through the suba-seal in one portion. The reaction mixture was maintained at the reaction temperature for 3-4 hours to produce the polymer product as a solution in solvent. In some instances, the solvent was removed by evaporation under vacuum.

The specific details of polymers that were prepared are as follows:

Homopolymer A—Comparative Example

The reaction with solvent (ethyl acetate) 30 g, lauryl methacrylate 20 g and t-butylperoxyperpivalate 0.25 ml, afforded 20.5 g of product (solvent removed) with GPC Mw of 71600 versus polystyrene.

Copolymer B

The reaction with solvent (ethyl acetate) 30 g, lauryl methacrylate 19 g, t-butylaminoethylmethacrylate 1 g and t-butylperoxyperpivalate 0.5 ml, afforded 20.5 g of product (solvent removed) with GPC Mw of 50400 versus polystyrene.

Copolymer C

The reaction with solvent (ethyl acetate) 30 g, lauryl methacrylate 19 g, dimethylaminoethylmethacrylate 1 g and t-butylperoxyperpivalate 0.5 ml, afforded 20 g of product (solvent removed) with GPC Mw of 55300 versus polystyrene.

Copolymer D

The reaction with solvent (ethyl acetate) 30 g, isodecyl methacrylate 19 g, t-butylaminoethylmethacrylate 1 g and t-butylperoxyperpivalate 0.5 ml, afforded 20 g of product (solvent removed) with GPC Mw of 38600 versus polystyrene.

Copolymer E

The reaction with solvent (ethyl acetate) 30 g, isodecyl methacrylate 20 g, t-butylaminoethylmethacrylate 0.3 g and t-butylperoxyperpivalate 1.2 ml, afforded 19.8 g of product (solvent removed) with GPC Mw of 26700 versus polystyrene.

Copolymer F

The reaction with solvent (cumene) 30 g, isodecyl methacrylate 20 g, t-butylaminoethylmethacrylate 0.3 g and t-butylperoxyperpivalate 1.2 ml, afforded 19.2 g of product (solvent removed) with GPC Mw of 24800 versus polystyrene.

Copolymer G

The reaction with solvent (ethyl acetate) 30 g, 2-ethylhexyl methacrylate 20 g, t-butylaminoethylmethacrylate 0.3 g and t-butylperoxyperpivalate 1.2 ml, afforded 19.2 g of product (solvent removed) with GPC Mw of 23200 versus polystyrene.

Copolymer H

The reaction with solvent (cumene) 30 g, 2-ethylhexyl methacrylate 20 g, t-butylaminoethylmethacrylate 0.3 g and t-butylperoxyperpivalate 1.2 ml, afforded 18.2 g of product (solvent removed) with GPC Mw of 18000 versus polystyrene.

Copolymer I

The reaction with solvent (ethyl acetate) 30 g, 2-ethylhexyl methacrylate 19 g, t-butylaminoethylmethacrylate 1 g and t-butylperoxyperpivalate 0.5 ml, afforded 19.9 g of product (solvent removed) with GPC Mw of 33100 versus polystyrene.

Copolymer J

The reaction with solvent (ethyl acetate) 30 g, 2-ethylhexyl methacrylate 20 g, 3-(dimethylamino)propyl methacrylamide 0.3 g and t-butylperoxyperpivalate 1.2 ml, afforded 20.4 g of product (solvent removed) with GPC Mw of 28000 versus polystyrene.

Copolymer K

The reaction with solvent (cumene) 30 g, 2-ethylhexyl methacrylate 20 g, dimethylaminoethyl methacrylate 0.3 g and t-butylperoxyperpivalate 1.3 ml, afforded 16 g of product (solvent removed) with GPC Mw of 25200 versus polystyrene.

Copolymer L

The reaction with solvent (Solvesso 150/Ethyl acetate 2:1) 457 g, isodecyl methacrylate 300 g, dimethylaminoethylmethacrylate 4.65 g and t-butylperoxyperpivalate 9.1 ml, afforded product with GPC Mw of 21000 versus polystyrene.

Copolymer M

The reaction with solvent (ethyl acetate) 270 g, isodecyl methacrylate 27 g, dimethylaminoethylmethacrylate 3 g and t-butylperoxyperpivalate 3.6 ml, afforded 30.4 g product (solvent removed) with GPC Mw of 5753 versus polystyrene.

Copolymer N

The reaction with solvent (ethyl acetate) 270 g, isodecyl methacrylate 29.6 g, 3-(dimethylamino)propylmethacrylamide 0.45 g and t-butylperoxyperpivalate 3.6 ml, afforded 30.8 g of product (solvent removed) with GPC Mw of 6641 versus polystyrene.

Copolymer O

The reaction with solvent (ethyl acetate) 270 g, isodecyl methacrylate 27 g, 3-(dimethylamino)propylmethacrylamide 3 g and t-butylperoxyperpivalate 3.6 ml, afforded 30.5 g of product (solvent removed) with GPC Mw of 4302 versus polystyrene.

Copolymer P

The reaction with solvent (ethyl acetate) 270 g, 2-ethylhexyl methacrylate 29.6 g, dimethylaminoethylmethacrylate 0.45 g and t-butylperoxyperpivalate 3.6 ml, afforded 31.8 g of product (solvent removed) with GPC Mw of 5759 versus polystyrene.

Copolymer Q

The reaction with solvent (ethyl acetate) 270 g, 2-ethylhexyl methacrylate 27 g, dimethylaminoethylmethacrylate 3 g and t-butylperoxyperpivalate 3.6 ml, afforded 30.1 g of product (solvent removed) with GPC Mw of 5335 versus polystyrene.

Copolymer R

The reaction with solvent (ethyl acetate) 270 g, 2-ethylhexyl methacrylate 27 g, dimethylaminopropylmethacrylamide 3 g and t-butylperoxyperpivalate 3.6 ml, afforded 31.0 g of product (solvent removed) with GPC Mw of 3605 versus polystyrene.

Terpolymer A

The reaction with solvent (ethyl acetate) 30 g, lauryl methacrylate 9.5 g, isodecyl methacrylate 9.5 g, t-butylaminoethylmethacrylate 1 g and t-butylperoxyperpivalate 0.5 ml, afforded 19.9 g of product (solvent removed) with GPC Mw of 42300 versus polystyrene Terpolymer B The reaction with solvent (ethyl acetate) 30 g, lauryl methacrylate 15 g, isodecyl methacrylate 4 g, t-butylaminoethylmethacrylate 1 g and t-butylperoxyperpivalate 0.5 ml, afforded 20.2 g of product (solvent removed) with GPC Mw of 44700 versus polystyrene The polymers prepared were tested using the Hot Liquid Process Simulator and the Microseparometer.

HLPS, Hot Liquid Process Simulator

In this test, fuel is circulated in a laminar fashion over a tube heated to 335° C. for 5 hours. The metallurgy of the tube can be aluminium or steel and the deposits can be measured either by Ellipsoidal Thermal Analysis (ETA), which measures the volume of deposit formed and/or the maximum deposit thickness (in nm), or by carbon burn-off, which measures the weight of carbon on the tube (can only be done on stainless steel tubes). The fuel used was a blend of Jet Fuel components (Base Fuel 1) and the tube metallurgy used was aluminium.

The polymers were added to the base fuel using a treat rate of 150 ppm active matter plus 25 ppm BHT (2,6-di-t-butyl-4-methyl phenol or butylated hydroxy toluene) and 3 ppm metal deactivator (,N'-disalicylidene propylene diamine).

Fuel Details, Base Fuel 1:

| Test | Units | Result |
|---|---|---|
| Density @ 15° C. | kg/l | 792.2 |
| Distillation | | |
| IBP | ° C. | 150.3 |
| 5% | | 168.0 |
| 10% | | 172.8 |
| 20% | | 180.8 |
| 30% | | 186.7 |
| 40% | | 192.9 |
| 50% | | 199.7 |
| 60% | | 207.4 |
| 70% | | 216.5 |
| 80% | | 227.8 |
| 90% | | 243.9 |
| 95% | | 257.9 |
| FBP | | 278.2 |
| RESIDUE | vol % | 1.5 |
| LOSS | vol % | 0.0 |
| Viscosity at −20° C. IP71 | $mm^2/s$ | 6.09 |
| JFTOT Break Point | ° C. | 245 |

MSEP: ASTM D3948 (Microseparometer)

This test is used to ensure Jet Fuel does not disarm coalescers, i.e. ground-based water-separators. Fuel is doped with water and agitated to form a fine emulsion, which is then passed through a standard coalescer cartridge and the turbidity of the fuel measured. If the fuel is clear, this means that the water has been successfully coalesced; if, on the other hand, the fuel is cloudy, the coalescer has not worked. The result is compared to the fuel pre-emulsion. The best possible rating is 100. A rating of 0 implies a very cloudy fuel i.e. the coalescer has not worked. The specification for jet fuels depends on approved additives which may have been added, e.g. static dissipater, but the minimum required rating is 70. A kerosene (Base Fuel 2) was used as the base fuel.

Fuel Details, Base Fuel 2:

| Test | Units | Result |
|---|---|---|
| Distillation D86 | | |
| IBP | ° C. | 161.2 |
| 5% | | 178.2 |
| 10% | | 187 |
| 20% | | 196.7 |
| 30% | | 204.1 |
| 40% | | 210.9 |
| 50% | | 217.7 |
| 60% | | 224.2 |
| 70% | | 231.2 |
| 80% | | 238.7 |
| 90% | | 249.3 |
| 95% | | 258.5 |
| FBP | | 268.2 |
| Sulphur ASTM D4294 | wt % | 0.02 |
| Mercaptan Sulphur IP342/00, D3227 | % m/m | 0.0002 |
| Freezing point IP16/98 or D2386 | ° C. | −49.4 |
| Viscosity at −20 C IP71 | $mm^2/s$ | 3.286 |
| Water reaction - int rating | | 1B/2 |
| WSIM | WSIM | 93 |

Results

It should be noted that owing to the presence of these materials in the fuel there was no need for the HLPS pressure bypass to be opened, thus this data is omitted from the following table. The ETA peak max data is a measurement of the maximum deposit thickness (in nm). Low values for both ETA deposit and ETA peak max indicate high cleanliness. The Visual Rating is determined within a range from 0 (good) to 4(bad). A suffix 'A' indicates that abnormalities were observed.

| | HLPS | | | |
|---|---|---|---|---|
| Additive | ETA Deposit volume ($cm^3$) | ETA Peak Max. (nm) | Visual Rating | MSEP @ 100 ppm |
| Homopolymer A-Comparative Example | 6.23E−05 | 252 | 3 | 99 |
| Copolymer B | 3.22E−05 | 176 | 3 | 96 |
| Copolymer C | 1.36E−05 | 78 | 2 | 87 |
| Copolymer D | 2.10E−05 | 110 | <3 | 95 |
| Copolymer E | 2.81E−05 | 137 | 3 | 100 |
| Copolymer F | 2.60E−05 | 148 | <3 | 99 |
| Copolymer G | 2.26E−05 | 141 | <3 | 96 |
| Copolymer H | 1.76E−05 | 109 | <3 | 98 |
| Copolymer I | 2.00E−05 | 109 | <3 | 93 |
| Copolymer J | 2.19E−05 | 126 | 2 | 96 |
| Copolymer K | 2.15E−05 | 107 | <3 | 98 |
| Terpolymer A | 2.18E−05 | 122 | <3 | 96 |
| Terpolymer B | 2.07E−05 | 127 | <3 | 96 |

The results show that the comparative example, Homopolymer A, has virtually no impact on water separability with an MSEP value of 99, but it only shows modest cleanliness. The copolymers, terpolymers and polymers of acrylic acid and methacrylic acid exhibit both good cleanliness and good water separability.

Additional examples of the polymethacrylate copolymers provide the following excellent high temperature deposit control within the HLPS at reduced treat rates. The additives were added to the fuel at a treat rate of 75 ppm active matter plus 25 ppm BHT (2,6-di-t-butyl-4-methyl phenol or butylated hydroxy toluene), 25 ppm Naugalube® 438L (an alkylated diphenylamine) and 10 ppm metal deactivator (N,N'-disalicylidene propylene diamine).

| | | HLPS | |
|---|---|---|---|
| Additive | ETA Deposit volume ($cm^3$) | ETA Peak Max. (nm) | Visual Rating |
| Base fuel | 1.68E−04 | 446 | >4 |
| Copolymer L | 2.67E−05 | 126 | <3 |
| Copolymer M | 2.53E−05 | 117 | <3 |
| Copolymer N | 2.67E−05 | 113 | <4 |
| Copolymer O | 1.89E−05 | 86 | <3A |
| Copolymer P | 2.75E−05 | 116 | <3 |
| Copolymer Q | 1.88E−05 | 96 | <3A |
| Copolymer R | 1.82E−05 | 85 | 2 |

What is claimed is:

1. A method of inhibiting deposit formation in a jet fuel at temperatures above 150° C. whilst not substantially adversely affecting the water separability of the jet fuel; the method consisting of:

adding at least one copolymer. terpolymer or polymer of an ester of acrylic acid or methacrylic acid which includes nitrogen-containing, amine-containing or amide-containing branches formed from the copolymerization of a polymer of methacrylate ester of a $C_8$ to $C_{14}$ alcohol and a methacrylate ester of an N,N-dialkylaminoalkyl alcohol which does not contain amide-containing monomers or amide-containing branches to the jet fuel.

2. The method of claim 1, in which the copolymer, terpolymer or polymer of an ester of acrylic acid or methacrylic acid or derivative thereof has a number average molecular weight of about 5,000 to about 100,000.

3. The method of claim 1, in which the copolymer, terpolymer or polymer of an ester of acrylic acid or methacrylic acid or derivative thereof includes about 0.01 to about 5 wt. % nitrogen.

4. The method of claim 1, in which the copolymer, terpolymer or polymer of an ester of acrylic acid or methacrylic acid or derivative thereof is used in an amount of about 5 to about 1,000 ppm (by weight).

5. A method of improving the thermal-oxidative stability of a jet fuel at temperatures above 150° C., whilst not substantially adversely affecting the water separability of the jet fuel; the method consisting of adding at least one copolymer, terpolymer or polymer of an ester of acrylic acid or methacrylic acid which includes nitrogen-containing, amine-containing or amide-containing branches formed from the copolymerization of a polymer of methacrylate ester of a $C_8$to $C_{14}$ alcohol and a methacrylate ester of an N,N-dialkylaminoalkyl alcohol which does not contain amide-containing monomers or amide-containing branches to the jet fuel; and adding at least one antioxidant to the jet fuel.

6. The method of claim 5, in which the anti-oxidant is an aminic or phenolic antioxidant.

7. A method of improving the thermal-oxidative stability of a jet fuel at temperatures above 150° C., whilst not substantially adversely affecting the water separability of the jet fuel; the method consisting of adding at least one copolymper, terpolvmer or polymer of an ester of acrylic acid or methacrylic acid which includes nitrogen-containing, amine-containing,or amide-containing branches formed from the copolymerization of a polymer of methacrylate ester of a $C_8$ tO $C_{14}$ alcohol and a methacrylate ester of an N,N-dialkylaminoalkvl alcohol which does not contain amide-containing monomers or amide-containing branches to the jet fuel;

adding at least one antioxidant to the jet fuel; and adding at least one dispersant to the jet fuel.

* * * * *